US006668572B1

(12) United States Patent
Seo et al.

(10) Patent No.: US 6,668,572 B1
(45) Date of Patent: Dec. 30, 2003

(54) AIR CONDITIONER HAVING HOT/COLD WATER PRODUCING DEVICE

(75) Inventors: Kook-Jeong Seo, Seoul (KR); Man-Hoe Kim, Seoul (KR); Jong-Kweon Ha, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/316,098

(22) Filed: Dec. 11, 2002

(30) Foreign Application Priority Data

Aug. 6, 2002 (KR) ..... 2002-46370

(51) Int. Cl.[7] ..... F25B 27/00

(52) U.S. Cl. ..... 62/238.6; 237/2 B; 62/161; 62/238.7; 62/324.6; 62/228.4

(58) Field of Search ..... 62/238.6, 160, 62/228.4, 324.6, 238.7; 237/2 B

(56) References Cited

U.S. PATENT DOCUMENTS 4,238,933 A * 12/1980 Coobos ..... 62/238
4,592,206 A * 6/1986 Yamazaki et al. ..... 62/160
5,947,373 A * 9/1999 Saito et al. ..... 237/2
6,062,035 A * 5/2000 Ueno ..... 62/324.1
6,293,119 B1 9/2001 Wenzel
6,314,744 B1 * 11/2001 Ogawa ..... 62/79
6,418,737 B1 * 7/2002 Kuroki et al. ..... 62/156
6,425,257 B1 * 7/2002 Ohseki et al. ..... 62/323.1
6,427,479 B1 * 8/2002 Komatsubara et al. ..... 62/503
6,434,937 B2 * 8/2002 Takamatsu ..... 60/597

* cited by examiner

*Primary Examiner*—William C. Doerrler
*Assistant Examiner*—Mark S. Shulman
(74) *Attorney, Agent, or Firm*—Staas & Halsey LLP

(57) ABSTRACT

An air conditioner including a compressor compressing a refrigerant to produce a high temperature gaseous refrigerant, a hot water producing device producing hot water by performing a heat exchanging process whereby heat is transferred from the high temperature refrigerant fed from the compressor to water, an outdoor heat exchanger performing a heat exchanging process whereby heat is transferred between the refrigerant and outside air, and a hot/cold water producing device producing hot water by performing a heat exchanging process whereby heat is transferred from the refrigerant fed from the hot water producing device to water, or producing cold water by performing a heat exchanging process whereby heat is transferred from water to the refrigerant fed from the outdoor heat exchanger.

19 Claims, 4 Drawing Sheets

AIR CONDITIONER HAVING HOT/COLD WATER PRODUCING DEVICE

CROSS-REFERENCE TO RELATED APPLICATIONS

This application claims the benefit of Korean Application No. 2002-46370, filed Aug. 06, 2002, in the Korean Industrial Property Office, the disclosure of which is incorporated herein by reference.

BACKGROUND OF THE INVENTION

1. Field of the Invention

The present invention relates generally to an air conditioner, and more particularly, to an air conditioner having a hot/cold water producing device, capable of heating or cooling room air in accordance with a selected mode.

2. Description of the Related Art

Generally, there has been widely used a method of heating water by heat generated when burning fossil fuel or of heating water using an electric heater, in a hot water producing device. In addition, there has been proposed a hot water producing device using the principle of an air conditioner. Such a hot water producing device is designed such that a refrigerant is compressed in a compressor to produce a refrigerant having a high temperature and a high pressure, and heat is transferred from the high temperature refrigerant to water so as to heat the water.

Such a conventional hot water producing device using the principle of an air conditioner will be described in the following with reference to FIG. 1. As shown in the FIG. 1, a refrigerant is compressed to produce a refrigerant having a high temperature and a high pressure in a compressor 102. Thereafter, the refrigerant sequentially passes a hot water producing heat exchanger 104, an expansion valve 106, and an evaporator 108, and then returns to the compressor 102. In the hot water producing heat exchanger 104, heat is transferred from the refrigerant to water. That is, relatively low temperature water absorbs the heat from the high temperature refrigerant, so the temperature of the refrigerant is reduced and the temperature of water is increased. While the refrigerant fed from the hot water producing heat exchanger 104 sequentially passes the expansion valve 106 and the evaporator 108, the phase of the refrigerant is changed to a gaseous phase with a low temperature and a low pressure, and the gaseous refrigerant then returns to the compressor 102.

Water, absorbing heat from the refrigerant in the hot water heat exchanger 104, is stored in a hot water storage tank 112. The stored hot water is supplied to a required place through a hot water supply pipe (not shown). When water of the hot water storage tank 112 is consumed, water is replenished from an external water supply source. A circulation pump 110 is used to forcibly circulate water between the hot water storage tank 112 and the hot water producing heat exchanger 104.

Such a conventional hot water producing device using a refrigerant uses the principle and the basic construction of an air conditioner, but does not provide an air-conditioning effect. Further, the conventional hot water producing device serves to produce only hot water, so it is not versatile and is inefficient to use.

SUMMARY OF THE INVENTION

Accordingly, it is an aspect of the present invention to provide an air conditioner, which is provided with a hot/cold water producing device in addition to a hot water producing device, thus heating or cooling room air in addition to supplying hot water.

Additional aspects and advantages of the invention will be set forth in part in the description which follows and, in part, will be obvious from the description, or may be learned by practice of the invention.

The foregoing and other aspects of the present invention are achieved by providing an air conditioner comprising a compressor compressing a refrigerant to produce a high temperature gaseous refrigerant, a hot water producing device to produce hot water by performing a heat exchanging process whereby heat is transferred between water and the high temperature refrigerant fed from the compressor, an outdoor heat exchanger performing a heat exchanging process whereby heat is transferred between the refrigerant and outside air, and a hot/cold water producing device to produce hot water by performing a heat exchanging process whereby heat is transferred between water and the refrigerant fed from the hot water producing device, or to produce cold water by performing a heat exchanging process whereby heat is transferred between water and the refrigerant fed from the outdoor heat exchanger.

BRIEF DESCRIPTION OF THE DRAWINGS

These and other aspects and advantages of the invention will become apparent and more readily appreciated from the following description of the preferred embodiments, taken in conjunction with the accompanying drawings of which.

The above and other aspects, features and other advantages of the present invention will be more clearly understood from the following detailed description taken in conjunction with the accompanying drawings, in which.

DETAILED DESCRIPTION OF THE PREFERRED EMBODIMENTS

Figure 1:
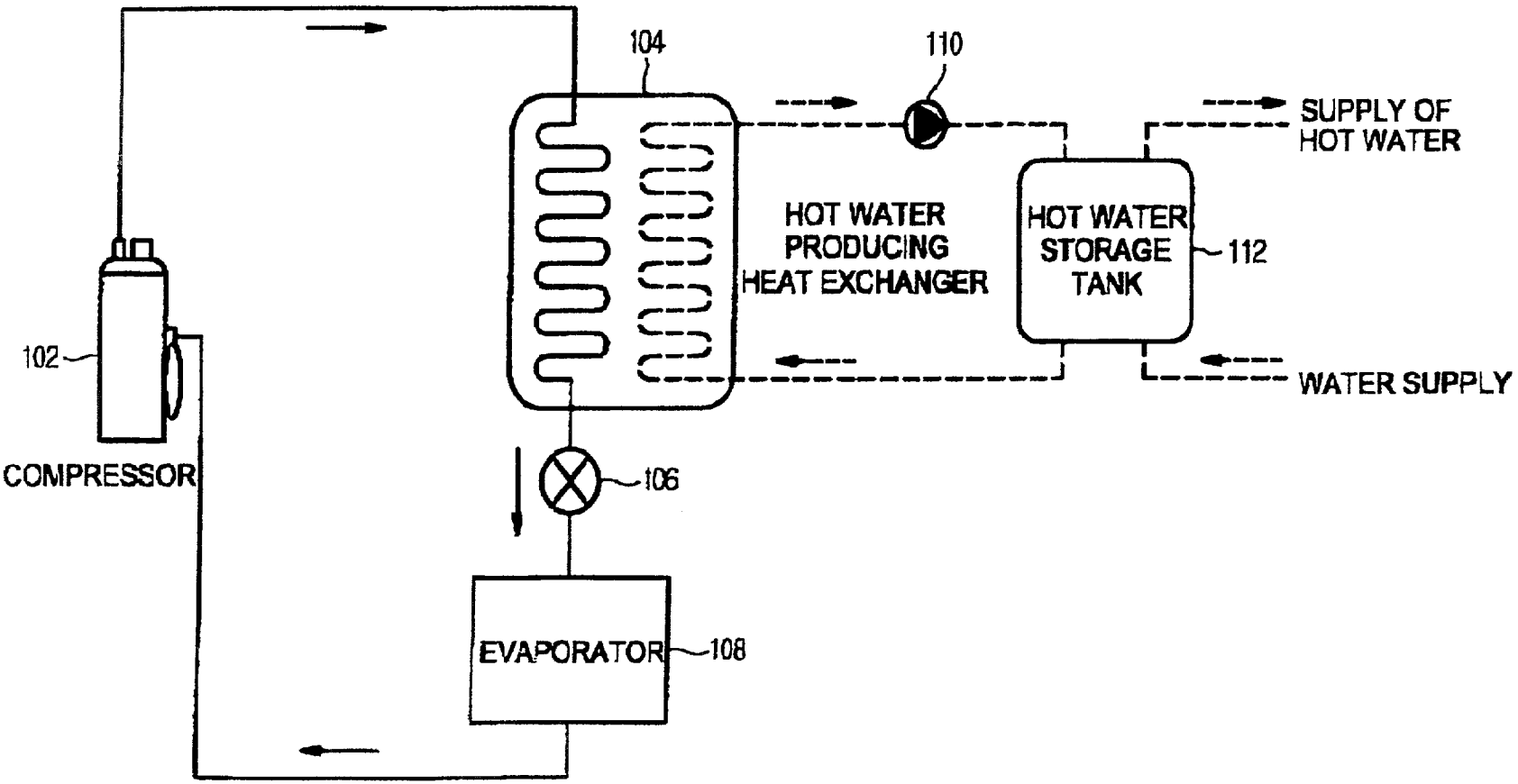
FIG.1 (PRIOR ART)
FIG. 1 is a view showing a conventional hot water producing device using a refrigerant.

Reference will now be made in detail to the present preferred embodiments of the present invention, examples of which are illustrated in the accompanying drawings, wherein like reference numerals refer to like elements throughout.

Figure 2:
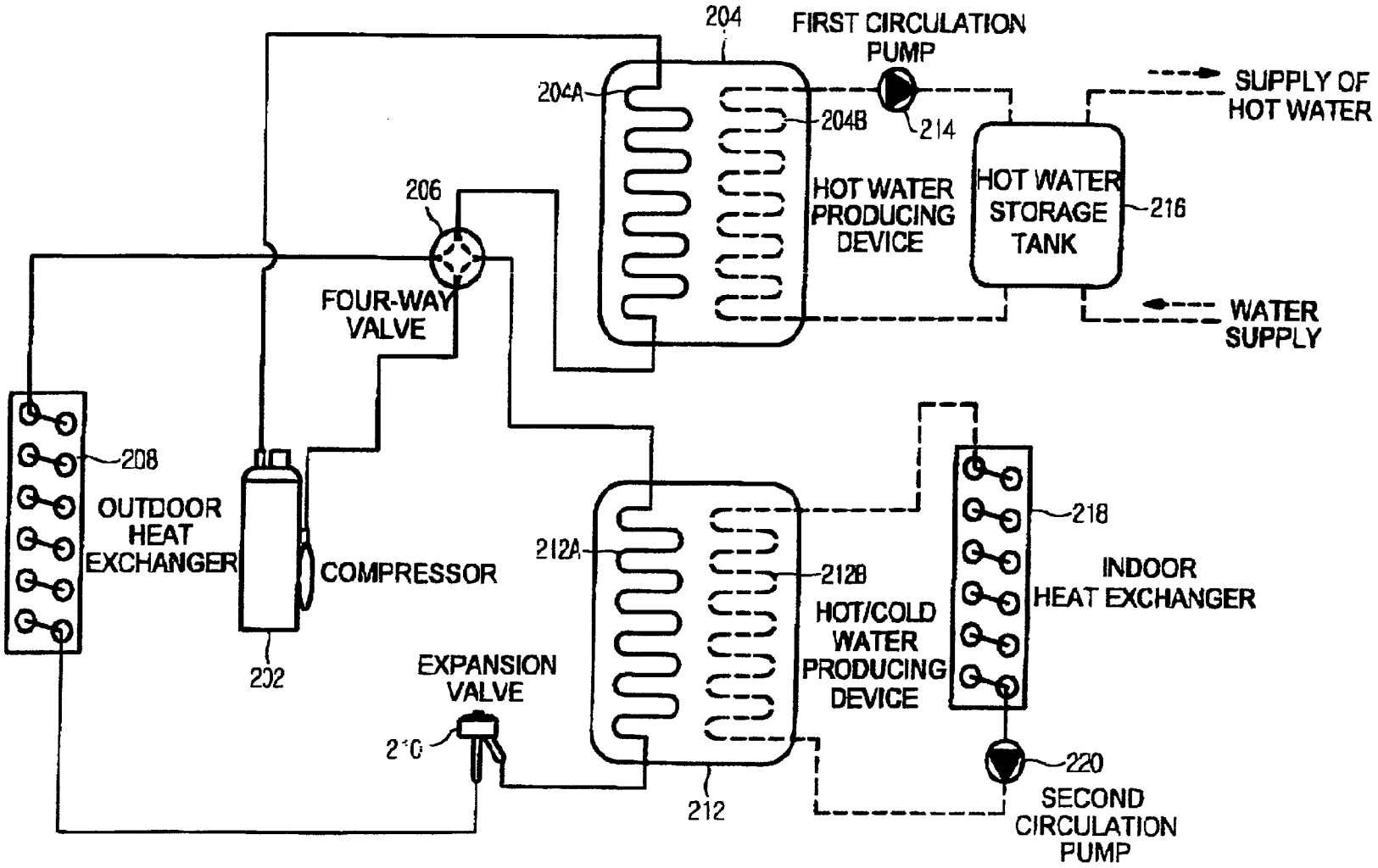
FIG. 2 is a view showing the construction of an air conditioner having a hot/cold water producing device according to an embodiment of the present invention.

An air conditioner having a hot/cold water producing device according to an embodiment of the present invention will be described in the following with reference to FIGS. 2, 3A and 3B. FIG. 2 is a view showing the construction of the air conditioner having the hot/cold water producing device according to an embodiment of the present invention. As shown in FIG. 2, a compressor 202 compresses a refrigerant to produce a gaseous refrigerant having a high temperature and a high pressure. A hot water producing device 204 serves as a heat exchanger to produce hot water by performing a heat exchanging process whereby heat is transferred from the high temperature refrigerant fed from the compressor 202 to a relatively low temperature water. The air conditioner of FIG. 2 uses carbon dioxide ($CO_2$) as the refrigerant in an effort to reduce environmental contamination.

Hot water produced in the hot water producing device 204 is stored in a hot water storage tank 216. A first circulation pump 214 is installed to smoothly circulate water between the hot water producing device 204 and the hot water storage tank 216. A four-way valve 206 controls the flowing direction of the refrigerant according to a selected operational mode of the air conditioner of this invention, that is, a cooling mode or a heating mode such that the refrigerant from the hot water producing device 204 is fed to an outdoor heat exchanger 208 or a hot/cold water producing device 212. In a cooling mode, the outdoor heat exchanger 208 performs a heat exchanging process whereby heat is transferred from the gaseous refrigerant having a high temperature and a high pressure to outside air so as to produce a high pressure gaseous refrigerant which still has a higher temperature than that of the outside air. The refrigerant is, thereafter, fed to an expansion valve 210 where the pressure of the refrigerant fed from the outdoor heat exchanger 208 is reduced. On the other hand, in a heating mode, the expansion valve 210 reduces the pressure of a refrigerant fed from the hot/cold water producing device 212.

The hot/cold water producing device 212 is a heat exchanger to produce hot or cold water by performing a heat exchanging process whereby heat is transferred between a high or low temperature refrigerant and water. The hot/cold water producing device 212 produces cold water in a cooling mode, and produces hot water in a heating mode. Hot or cold water produced in the hot/cold water producing device 212 is fed to an indoor heat exchanger 218 so as to heat or cool room air. A second circulation pump 220 is installed to smoothly circulate water between the indoor heat exchanger 218 and the hot/cold water producing device 212.

Since a refrigerant pipe 212A of the hot/cold water producing device 212 is not directly connected to the indoor heat exchanger 218, it is possible to minimize the length of the refrigerant pipe 212A. Further, the reason why the refrigerant pipe 212A is not directly connected to the indoor heat exchanger 218 is to overcome a problem that the indoor heat exchanger 218 may have a structural defect, and fail to endure the excessively high pressure and unexpectedly explode when the operational pressure of the $CO_2$ used as the refrigerant reaches 80~150 atm. As a result, the hot/cold water producing device 212, producing hot or cold water to heat or cool room air, makes it easy to maintain and repair the refrigerant pipe, and prevents the indoor heat exchanger 218 from unexpected explosion.

The operation of the air conditioner according to the present invention is as follows.

Figure 3A:
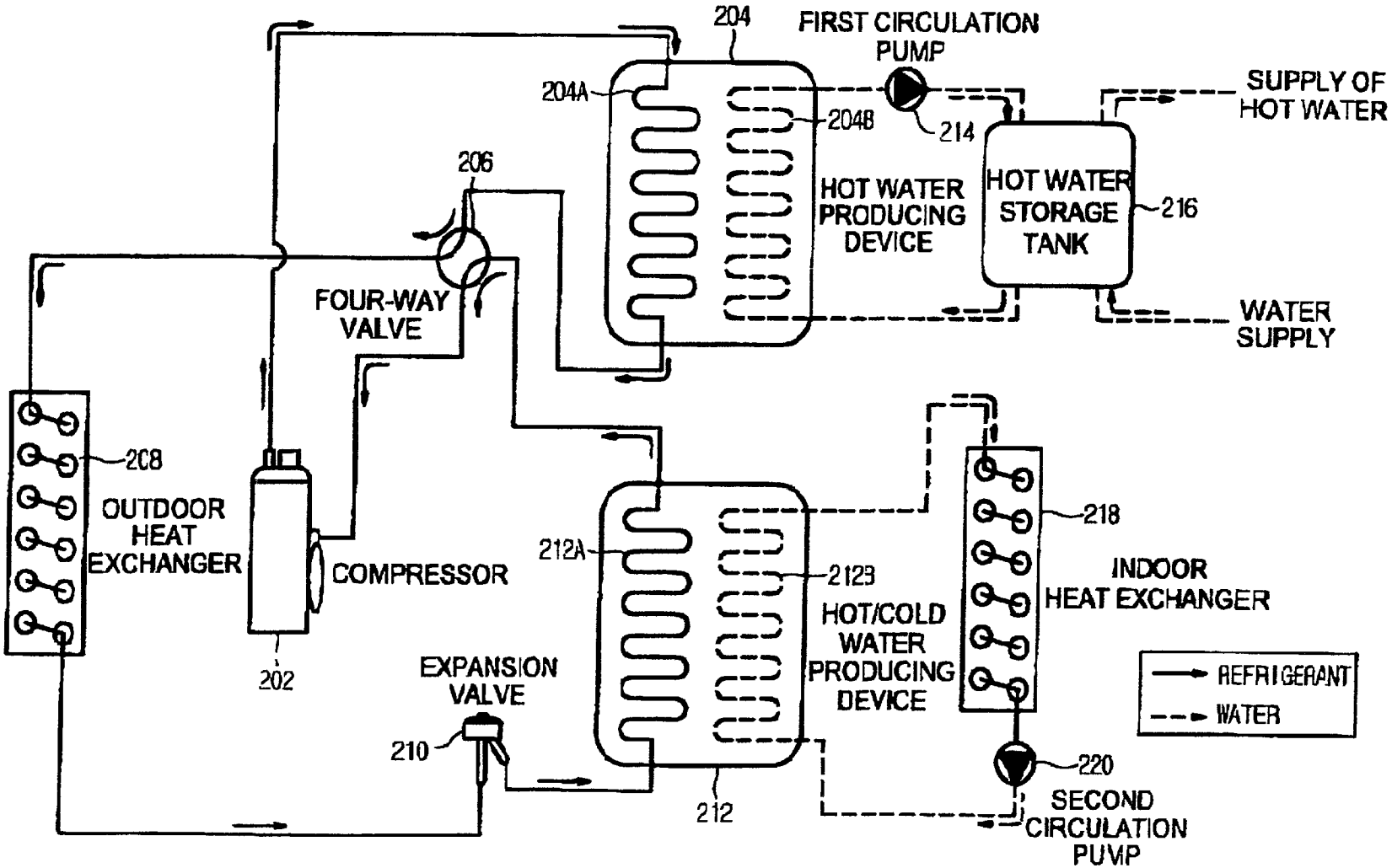
FIG. 3A is a view showing a refrigeration cycle of the air conditioner having the hot/cold water producing device according to FIG. 2, in a cooling mode.

FIG. 3A is a view showing a refrigeration cycle of the air conditioner having the hot/cold water producing device according to FIG. 2, in a cooling mode. In FIG. 3A, the arrows shown by solid lines show a flowing direction of the refrigerant, whereas the arrows shown by dotted lines show a flowing direction of water. In the cooling mode, hot water is produced in the hot water producing device 204, and cold water is produced in the hot/cold water producing device 212. That is, it is possible to produce hot water as well as cold water in the cooling mode, thus achieving the supply of hot water to a desired place as well as cooling room air in such a cooling mode.

As shown in FIG. 3A, when the gaseous refrigerant having a high temperature and a high pressure from the compressor 202 is fed to the hot water producing device 204, heat is transferred from the high temperature refrigerant to relatively low temperature water. Through such a heat exchanging process, the temperature of water is increased but the temperature of the refrigerant is reduced. As such, hot water produced in the hot water producing device 204 flows from said device 204 by an operation of the first circulation pump 214 and then is stored in the hot water storage tank 216. In such a case, the refrigerant fed from the hot water producing device 204 flows into the outdoor heat exchanger 208 through the four-way valve 206. In this case, heat is transferred from the high temperature refrigerant to relatively low temperature outside air in the outdoor heat exchanger 208, so the temperature of the refrigerant is further reduced. The expansion valve 210 reduces the pressure of the gaseous refrigerant having a high pressure fed from the outdoor heat exchanger 208, thus making a low temperature and a low pressure refrigerant which flows into the hot/cold water producing device 212, so cold water is produced in the hot/cold water producing device 212. When cold water, produced in the hot/cold water producing device 212, is fed into the indoor heat exchanger 218, the cold water absorbs heat from room air, so the temperature of room air is reduced and the temperature of the cold water is increased. The refrigerant from the hot/cold water producing device 212 returns to the compressor 202 via the four-way valve 206. As such, the air conditioner according to the present invention produces both hot water and cold water in the cooling mode, thus achieving the supply of hot water and the room air cooling effect at the same time.

Figure 3B:
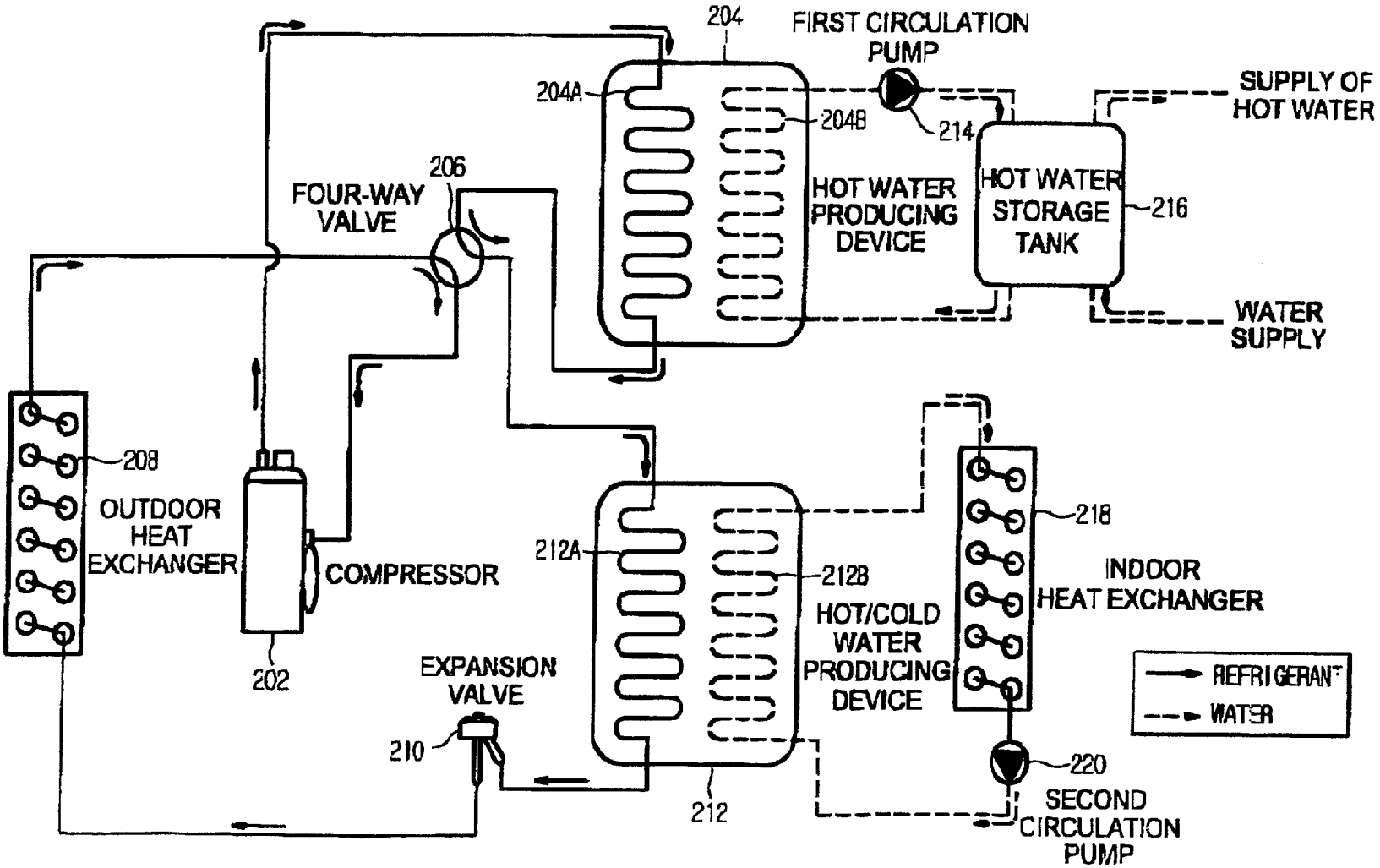
FIG. 3B is a view showing a refrigeration cycle of the air conditioner having the hot/cold water producing device according to FIG. 2, in a heating mode.

FIG. 3B is a view showing a refrigeration cycle of the air conditioner having the hot/cold water producing device according to FIG. 2, in a heating mode. In FIG. 3B, the arrows shown by solid lines show a flowing direction of the refrigerant, whereas the arrows shown by dotted lines show a flowing direction of water. In the heating mode, the air conditioner according to an embodiment of the present invention produces hot water in both the hot/cold water producing device 212 and the hot water producing device 204.

As shown in the FIG. 3B, when the gaseous refrigerant having a high temperature and a high pressure from the compressor 202 is fed to the hot water producing device 204, heat is transferred from the high temperature refrigerant to relatively low temperature water. Through such a heat exchanging process, the temperature of water in the hot water producing device 204 is increased but the temperature of the refrigerant is reduced. As such, hot water produced in the hot water producing device 204 flows by an operation of the first circulation pump 214 and then is stored in the hot water storage tank 216. The refrigerant from the hot water producing device 204 flows into the hot/cold water producing device 212 via the four-way valve 206. Since the refrigerant flowing into the hot/cold water producing device 212 still has a high temperature and a high pressure, heat is transferred from the high temperature refrigerant to the relatively low temperature water in said hot/cold water producing device 212, so the temperature of the refrigerant is reduced and the temperature of the water is increased, thus producing hot water. When the hot water produced in the hot/cold water producing device 212 is fed into the indoor heat exchanger 218, heat is transferred from the hot water to the relatively low temperature room air. At this time, as the temperature of the room air is increased, a room air heating effect is accomplished. That is, the air conditioner according to an embodiment of the present invention in the heating mode accomplishes the supply of hot water and the room air heating effect.

As described above, the present invention provides an air conditioner, which produces hot water and cools room air at the same time in a cooling mode, and which produces hot water and heats room air at the same time in a heating mode, thus always supplying hot water while heating or cooling room air.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An air conditioner, comprising:

a compressor compressing a refrigerant to produce a high temperature gaseous refrigerant;

a hot water producing device to produce hot water by performing a heat exchanging process wherein heat is transferred between water and the high temperature refrigerant fed from said compressor;

an outdoor heat exchanger performing a heat exchanging process wherein heat is transferred between the refrigerant and outside air; and a hot/cold water producing device to produce hot water by performing a heat exchanging process wherein heat is transferred between water and the refrigerant fed from the hot water producing device, or to produce cold water by performing a heat exchanging process wherein heat is transferred between water and the refrigerant fed from the outdoor heat exchanger.

2. The air conditioner according to claim 1, further comprising an indoor heat exchanger to heat or cool room air by performing a heat exchanging process wherein heat is transferred between the room air and hot or cold water fed from said hot/cold water producing device.

3. The air conditioner according to claim 1, wherein carbon dioxide is used as the refrigerant.

4. An air conditioner, comprising:

a compressor compressing a refrigerant to produce a high temperature refrigerant;

a hot water producing device to produce hot water by performing a heat exchanging process wherein heat is transferred between the high temperature refrigerant from said compressor and water having a relatively low temperature;

a hot/cold water producing device to produce hot or cold water, depending on a temperature of the refrigerant passing the hot/cold water producing device, by performing a heat exchanging process wherein heat is transferred between said refrigerant and water;

an outdoor heat exchanger performing a heat exchanging process wherein heat is transferred between the refrigerant fed from the hot water producing device and outside air in a cooling mode, or performing a heat exchanging process wherein heat is transferred between the refrigerant fed from the hot/cold water producing device and the outside air in a heating mode;

a four-way valve controlling a flowing direction of the refrigerant such that the refrigerant from said compressor flows into a selected one of the hot/cold water producing device and the outdoor heat exchanger according to a selected mode, that is, the cooling mode or the heating mode; and an expansion valve controlling pressure of the refrigerant such that the expansion valve reduces pressure of the refrigerant fed from the outdoor heat exchanger in the cooling mode, and reduces pressure of the refrigerant fed from the hot/cold water producing device in the heating mode.

5. The air conditioner according to claim 4, wherein said hot/cold water producing device produces cold water in the cooling mode, and produces hot water in the heating mode.

6. The air conditioner according to claim 4, wherein the hot or cold water produced in the hot/cold water producing device flows into an indoor heat exchanger to heat or cool room air through a heat exchanging process wherein heat is transferred between the hot or cold water and the room air.

7. The air conditioner according to claim 4, wherein carbon dioxide is used as the refrigerant.

8. The air conditioner according to claim 1, further comprising a hot water storage tank to store hot water from the hot water producing device.

9. The air conditioner according to claim 1, further comprising a circulation pump to circulate water between the hot water producing device and the hot water storage tank.

10. The air conditioner according to claim 1, further comprising a four-way valve to control the flowing direction of the refrigerant according to a selected operational mode.

11. The air conditioner according to claim 10, wherein in a cooling mode, the refrigerant is transferred from the hot water producing device to the outdoor heat exchanger.

12. The air conditioner according to claim 10, wherein in a heating mode, the refrigerant is transferred from the hot water producing device to the hot/cold water producing device.

13. The air conditioner according to claim 11, wherein in a cooling mode, the outdoor heat exchanger performs a heat exchanging process wherein heat is transferred from the gaseous refrigerant having a high temperature and a high pressure to outside air to produce high pressure gaseous refrigerant still having a higher temperature than the outside air.

14. The air conditioner according to claim 13, wherein the high pressure gaseous refrigerant is then fed to an expansion valve where the pressure of the refrigerant is reduced.

15. The air conditioner according to claim 4, wherein the hot/cold water producing device comprises a refrigerant pipe passing refrigerant therethrough, wherein the refrigerant pipe is not directly connected to the indoor heat exchanger.

16. The air conditioner according to claim 5, wherein hot water and cold water are produced simultaneously in the cooling mode.

17. The air conditioner according to claim 16, wherein hot water and room air cooling are achieved simultaneously.

18. The air conditioner according to claim 16, wherein hot water and room air heating are achieved simultaneously.

19. A method of conditioning air comprising:

compressing a refrigerant to produce a high temperature and high pressure gaseous refrigerant;

producing hot water by performing a heat exchanging process to transfer heat between water and the high temperature refrigerant fed from a compressor;

performing a heat exchanging process to transfer heat between the refrigerant and outside air; and producing hot water by performing a heat exchanging process whereby heat is transferred between water and the high temperature refrigerant fed from a hot water producing device or producing cold water by performing a heat exchanging process whereby heat is transferred between water and the refrigerant fed from an outdoor heat exchanger.

* * * * *